US005215020A

United States Patent [19]

Pordzik

[11] Patent Number: 5,215,020

[45] Date of Patent: Jun. 1, 1993

[54] OPTICAL DETECTOR MOUNTED ON A CIRCUIT BOARD IN A SEWING MACHINE NEEDLE PLATE

[75] Inventor: Horst Pordzik, Gerlingen, Fed. Rep. of Germany

[73] Assignee: Union Special GmbH, Stuttgart, Fed. Rep. of Germany

[21] Appl. No.: 884,435

[22] Filed: May 14, 1992

[30] Foreign Application Priority Data

May 17, 1991 [DE] Fed. Rep. of Germany ..... 4116273

[51] Int. Cl.[5] ..... D05B 19/00

[52] U.S. Cl. ..... 112/121.11; 112/272; 250/239

[58] Field of Search ..... 112/121.11, 272, 275, 112/277, 315, 314, 130; 250/239

[56] References Cited

U.S. PATENT DOCUMENTS 4,188,901 2/1980 Beckerman ..... 250/239 X
4,574,719 3/1986 Balke ..... 112/272
4,612,867 9/1986 Rosch et al. ..... 112/121.11 X
4,817,542 4/1989 Ando et al. ..... 112/272 X
4,967,676 11/1990 Hagino et al. ..... 112/272
5,013,911 5/1991 Koshida et al. ..... 250/239

FOREIGN PATENT DOCUMENTS 3519729 4/1986 Fed. Rep. of Germany .
2930228 11/1989 Fed. Rep. of Germany .
4024635 2/1991 Fed. Rep. of Germany ..... 112/272

*Primary Examiner*—Peter Nerbun
*Attorney, Agent, or Firm*—Willian Brinks Olds Hofer Gilson & Lione

[57] ABSTRACT

An optical sensor (22) for an evaluating device on a sewing machine has a light transmitter (4) and a light receiver (21), which is separate from the light transmitter (4), and is arranged in a needle plate (17) in the path of the beam from the light transmitter (4). The transition (24) between the needle plate (17) and the support (15) is designed as an interface (25) with predescribed positions for transferring electronic signals and predescribed positions being fitted as contacts (26,27) and counter-contacts (28,29).

9 Claims, 2 Drawing Sheets

OPTICAL DETECTOR MOUNTED ON A CIRCUIT BOARD IN A SEWING MACHINE NEEDLE PLATE

BACKGROUND OF THE INVENTION

The invention relates to a sewing machine having an optical detector.

Optical detectors are used on sewing machines for example to detect one or more layers of workpieces and in particular to detect the edges of workpieces. A preset evaluating device triggers control commands to the sewing machine control which can, for example, be used to operate a cutter or to terminate the sewing process.

An optical detector on a sewing machine to detect an edge of a workpiece is known from the German Offenlegungsschrift DE 35 19 729 Al. A light source arranged above the sewing level radiates a narrow-band frequency spectrum which is directed from the working area to an opto-electrical sensor by way of a separate light wave conductor, an evaluating device being inserted after the sensor. It is true that this solution is considerably independent from the basic construction of a sewing machine; it does, however, demand that a light wave conductor be attached in the work area, e.g. on the sewing machine table designed as a plate. Furthermore loss of light can occur in the light wave conductor.

An object of the invention is therefore to develop an optical detector comprising a light transmitter and a light receiver, so that light loss is avoided as much as possible and so that it is possible to install and remove the needle plate in a simple manner.

SUMMARY OF THE INVENTION

The invention resides in a controllably driven sewing machine having an optical detector and an evaluating device, the optical detector having a light transmitter and a light receiver which is arranged in a needle plate in the region of stitch formation separately from the light transmitter and in the path of the beam from the light transmitter and which is attached to a support at a transition between the needle plate and the support, the transition being designed as an interface with predescribed positions for the transfer of electronic signals.

By designing the transition between the needle plate and the support as an interface with predescribed positions for the transfer of electronic signals it is possible to simply install and remove the needle plate during repair and maintenance work.

By arranging the light receiver, designed for example as a phototransistor, on a circuit board fitted with conductor strips, it is possible to produce a compact construction, as known phototransistors for example only have a diameter of approximately 1.5 mm and a construction height of approximately 3 mm and therefore can even be integrated into a bridge piece of a needle plate, the bridge piece providing a recess. With the light receiver arranged directly in the stitch-forming region of the needle plate, e.g. in the region where a stitch is formed, the light beam of the light transmitter is able to function with a low amount of loss.

By attaching the contacts onto the circuit board and arranging the counter-contacts on a further circuit board arranged in the support it is possible to produce a particularly economical design of interface.

It is also advantageous for the interface to have a sealing device to prevent the penetration of dust and oil. A resilient sealing ring is arranged between the circuit boards and protects the contacts from undesired effects from the surroundings.

It is preferable for one of the circuit boards designed as a contact support to be arranged resiliently so as to compensate for tolerances when arranging the reception openings of the contact supports and so that sufficient contact pressure is guaranteed between the contacts. A resilient O-ring is fitted as a resilient device.

It is also advantageous to design the light transmitter as a light-emitting diode which emits light in the visible region of the spectrum. The light can be preferably emitted as a colored light, e.g. a red light with a photon wavelength in the region of the approximately 650 nm.

BRIEF DESCRIPTION OF THE DRAWINGS

The invention is described further, by way of example, with reference to the accompanying drawings, in which.

DETAILED DESCRIPTION OF THE PREFERRED EMBODIMENTS

Figure 1:
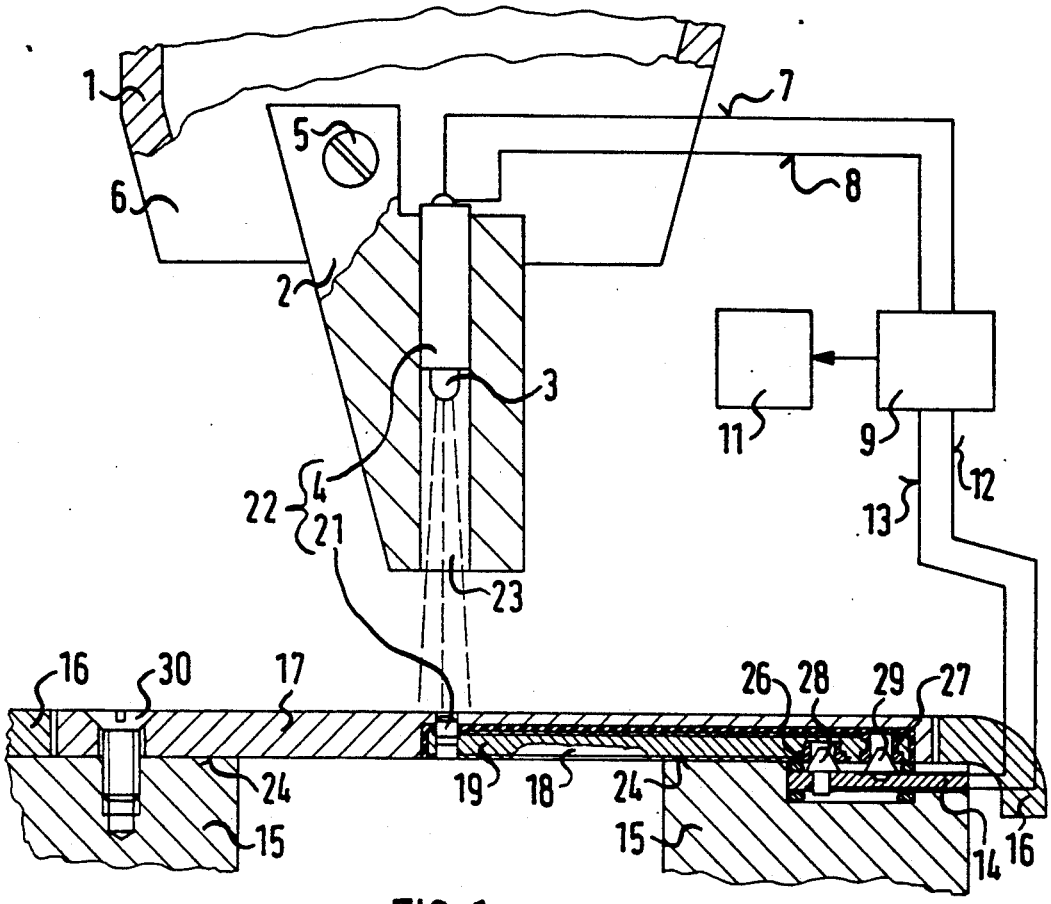
FIG. 1 is a sectional side view of a sewing machine with a vertically sectioned optical detector.

Referring to FIG. 1, a controllably powered sewing machine carries a holder 2, which contains a light transmitter 4 designed as a light-emitting diode 3. The holder 2 is attached to a front cover 6 of the sewing machine by a screw 5. Each of the control lines 7 and 8 connects the light transmitter 4 to an evaluating device 9, which for its part passes on control command to a sewing machine control 11 (schematically illustrated) for the controlled drive of the sewing machine 1. Control lines 12 and 13 connect a support 14 of the counter-contacts with the evaluating device 9.

Figure 2:
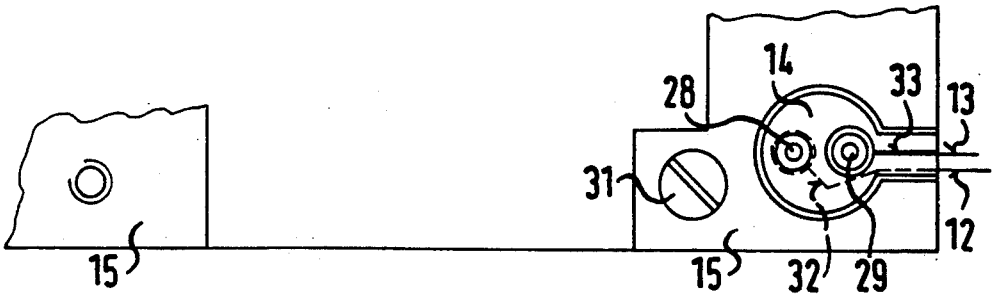
FIG. 2 is a plan of a support fitted with corresponding contacts.

A support 15 supports a plate 16 for the material to be sewn and a needle plate 17 which has a recess 18 with a circuit board 19 therein, a light receiver 21 being attached to the printed circuit board 19. The light transmitter 4 and the light receiver 21 arranged separately from the light transmitter 4 form an optical detector 22, which is an optical equivalent of a limit switch, the light receiver 21 being arranged in the path 23 of the beam from the light transmitter 4. A transition 24 between the needle plate 17 and the support 15 forms an insulating interface 25 with prescribed positions which are designed as contacts 26 and 27 and corresponding contacts 28 and 29 for transferring electronic signals. The needle plate 17 is attached by a screw 30 and a screw 31 (FIG. 2) respectively to the support 15, where the counter-contact support 14 is fitted with the conical counter-contacts 28 and 29. Conductor strips 32 and 33 fitted to the corresponding contact support 14 connect the counter-contacts 28,29 with the control lines 12 and 13.

Figure 3:
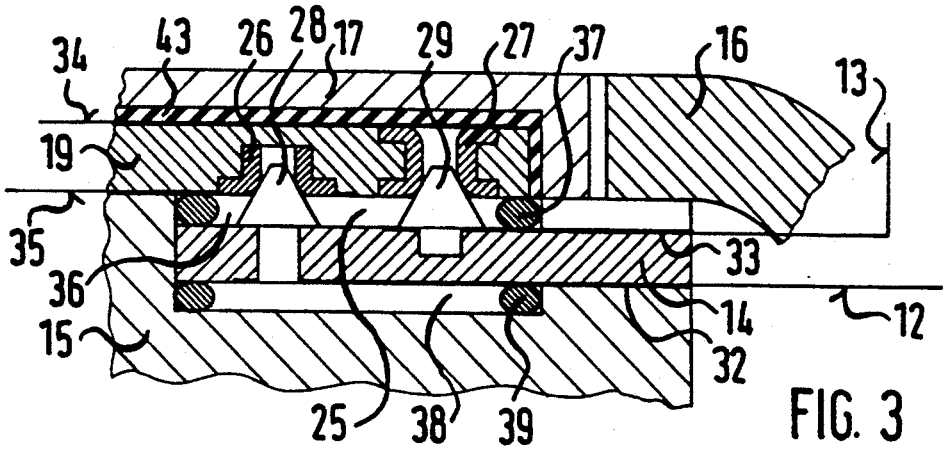
FIG. 3 is an enlarged view of a section of an interface.

As shown in FIG. 3, on the upper side of the circuit board 19 there is a conductor strip 34 which is conductively connected to the contact 27 which is designed as a tubular rivet and on the lower side there is a conductor strip 35, which is conductively connected with contact 26 designed as a short tubular rivet. A sealing device 36 circumferentially seals and encloses the insulating interface 25. The counter-contact support 14 designed as a circuit board and the circuit board 19 with a flexible gasket 37 are part of the sealing device 36.

A resilient ring 39 is fitted in a reception opening 38 of support 15 so that the counter-contacts 28 and 29 are arranged in resilient connection with the support 15 by way of the counter-contact support 14.

The conductor strips 32,33,34 and 35, apart from the contact points, are protected in the known manner by insulating lacquer.

Figure 4:
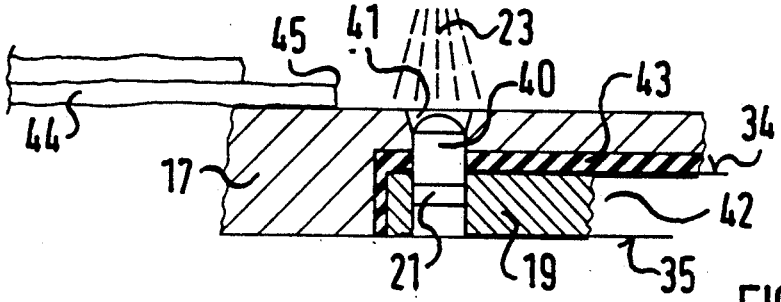
FIG. 4 is an enlarged view of a light receiver arranged in a needle plate.

FIG. 4 shows the arrangement of the light receiver 21 designed as a phototransistor 40 in the needle plate 17 which has an opening 41 for positioning the light receiver 21. The circuit board 19 is protected in the recess designed partly as groove 42 (FIG. 1, FIG. 5), by means of an adhesive mass similar to rubber. The conductor strip 34 is connected to the emitter and the strip conductor 35 is connected to the collector on the phototransistor 40. A workpiece 44 having a workpiece edge 45 is arranged on the upper side of the needle plate 17.

Figure 5:
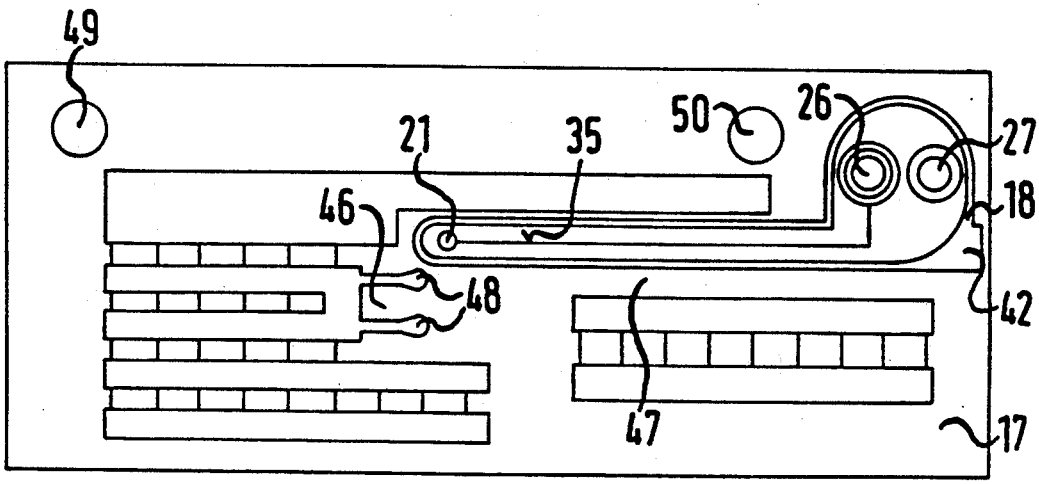
FIG. 5 is a needle plate with integrated interface, seen from below.

FIG. 5 shows the light receiver 21 fitted in a stitch forming region 46 of the needle plate 17 in the recess 18 of a bridge piece 47. Owing to the size of the phototransistor 40 it is possible to apply the light receiver 21 directly to a needle hole 48 of the needle plate 17. Bores 49 and 50 are used for screws 30 and 31 in accordance with FIGS. 1 and 2.

By loosening the screws 30 and 31 it is possible to remove the needle plate 17, as was previously usual, from the support 15 to carry out repair and maintenance work on the sewing machine, without there being the risk, for example, of damaging a sensitive light conductor. After the needle plate 17 has been reinstalled with the integrated interface 25, the optical detector is immediately operational without the loss of light, as the transfer to the evaluating device 9 of electronic signals, which are, for example, triggered by the detection of the edge 45 of the workpiece 44, is guaranteed by means of the insulating interface 25.

I claim:

1. A controllably driven sewing machine having an optical detector and an evaluating device, the optical detector having a light transmitter and a light receiver which is arranged in a needle plate in the region of stitch formation separately from the light transmitter and in the path of the beam from the light transmitter and which is attached to a circuit board positioned in a recess in the needle plate and having electrical contacts at a distal end to form a transition between the needle plate and a support, the transition being an interface for the transfer of electronic signals.

2. A sewing machine as claimed in claim 1, in which the circuit board is provided with conductor strips arranged in a recess in the needle plate.

3. A sewing machine as claimed in claim 1, in which the light receiver is a photo-transistor which is arranged in the immediate region of stitch formation on the needle plate.

4. A sewing machine as claimed in claim 2, in which counter-contacts are arranged in the support.

5. A sewing machine as claimed in claim 1, in which the interface is surrounded by a sealing device.

6. A sewing machine as claimed in claim 4, in which the counter-contacts are arranged in resilient connection with the support.

7. A sewing machine as claimed in claim 1, in which the light transmitter is designed as a light-emitting diode which emits light in the visible region of the spectrum.

8. A throat plate for a controllably driven sewing machine having an optical detector and an evaluating device, the throat plate comprising:

a needle plate having a recess;

a circuit board mounted in the recess;

a photo-transistor mounted on the circuit board such that the photo-transistor will be located in the immediate region of stitch formation on the needle plate; and electrical contacts operable to transmit an electronic signal from the photo-transistor through an interface between the needle plate and a support.

9. A controllably driven sewing machine comprising:

a sewing needle;

a needle plate having a recess;

a circuit board mounted in the recess;

a photo-transistor mounted on the circuit board such that the photo-transistor will be located in the immediate region of stitch formation on the needle plate;

electrical contacts operable to transmit an electronic signal from the photo-transistor;

a support; and electrical counter-contacts mounted on the support, the electrical counter-contacts being positioned on the support such that the counter-contacts are operable to transmit an electronic signal from the electrical contacts.

* * * * *